United States Patent [19]

Tincati

[11] Patent Number: 4,616,684

[45] Date of Patent: Oct. 14, 1986

[54] AUTOMATIC BOTTLING MACHINE BOTTLE HOLDER

[75] Inventor: Franco Tincati, Parma, Italy

[73] Assignee: SARCMI S.p.A., Noceto, Italy

[21] Appl. No.: 703,746

[22] Filed: Feb. 21, 1985

[30] Foreign Application Priority Data

Mar. 2, 1984 [IT] Italy ..... 40017 A/84

[51] Int. Cl.[4] ..... B65B 3/04

[52] U.S. Cl. ..... 141/114; 141/313; 141/372; 141/165

[58] Field of Search ..... 141/1-12, 141/37-66, 250-284, 369-381, 114, 313-317, 129-191

[56] References Cited

U.S. PATENT DOCUMENTS 924,360 6/1909 Kirkegaard ..... 141/372

*Primary Examiner*—Houston S. Bell, Jr.

*Attorney, Agent, or Firm*—Laff, Whitesel, Conte & Saret

[57] ABSTRACT

The invention relates to a device for clamping a container to a filler valve, in particular, the type of valve used in automatic bottling machinery for continuous liquid-batching processes. The device is embodied, substantially, as a frame (8) associated with and slidable relative to the body (2) of such a valve, which clamps the bottle (1) to the valve, raises it up to the level of a filler tube (3), and lowers it. The frame's sliding motion is produced by a roller (10) integral with the frame itself, which engages a stationary cam-type guide rail (11) during rotation of the machine.

6 Claims, 4 Drawing Figures

AUTOMATIC BOTTLING MACHINE BOTTLE HOLDER

BACKGROUND OF THE INVENTION

The invention described herein relates to a device for clamping a container to a filler valve, intended in particular for automatic bottling machinery of the type utilized in continuous liquid-batching processes.

The batching into bottles of liquids such as soda pop and mineral water is brought about currently with the aid of automatic machines, which in most instances are of the carousel type. Briefly, machines of the kind employ valves fitted to the periphery of a rotating structure, or carousel. These valves turn as one with the carousel in continuous rotation, and each incorporates a tube from which liquid is caused to flow into the bottle. A pedestal located directly below each valve receives single bottles from an infeed capstan, and is raised, usually by pneumatic actuator, up to the point where the bottle neck admits the tube and engages the valve by simple mechanical pressure. Arrival of the bottle in this position causes a cock to open, thereby permitting liquid to flow through the tube and into the bottle. Once the filling operation is completed, the pedestal is lowered once more, and the bottle conveyed away from the carousel by an exit capstan.

Machines of the type thus described subject the single bottles to a considerable degree of mechanical compression, which is withstood for the most part by glass bottles without any significant drawbacks, but which produces unacceptable degrees of distortion in plastic bottles, the use of which is steadily on the increase.

Attempts have been made to overcome the problem of compression by utilizing machines whose pedestals incoporate rods with a bifurcated component designed to lay hold, and thus discharge a part of the compressive stress, upon the bottle neck, which is generally the strongest section of the bottle. This particular method of dealing with the problem is unsatisfactory on two counts: first, it does not eliminate compression, since compressive stress is applied just the same, with inevitable distortion of the bottle; second, a machine already rendered complex in design by the inclusion of automated and pneumatically-actuated ascending-and-descending pedestals, is rendered even more complex by addition of the extra parts mentioned.

The object of the invention described herein is that of eliminating the drawbacks aforementioned, by setting forth a device which avoids imparting compressive stress to the bottle, and which at the same time is conductive to simple and economic embodiment of the bottling machine.

SUMMARY OF THE INVENTION

These objects and others are realized with the device according to the invention which is of the type comprising a valve body integral with the moving body of an automatic machine, incorporating a filler tube out of which, upon operation of the valve, liquid flows into the bottle, and designed to engage a bottle the neck of which is provided with an external projection, and is characterized in that it further comprises:

a clamping medium which is designed to engage the bottom side of said external projection, associated with the body of the valve in such a way as to slide relative thereto, and disposed such that the clamped bottle remains coaxial with the valve filler tube;

actuator means which operate the clamping medium in such a way as to bring about its passage from a lowered position in which the clamping medium and the bottle engaged thereby are located beneath the valve filler tube, to a raised position in which the clamping medium is brought up to the level of the tube, and the tube is inserted into the neck of the bottle.

BRIEF DESCRIPTION OF THE DRAWINGS

Additional features and advantages of the device will emerge from the detailed description of two embodiments which follows, set forth in conjunction with the accompanying drawings, in which.

DESCRIPTION OF THE PREFERRED EMBODIMENTS

Figure 1:
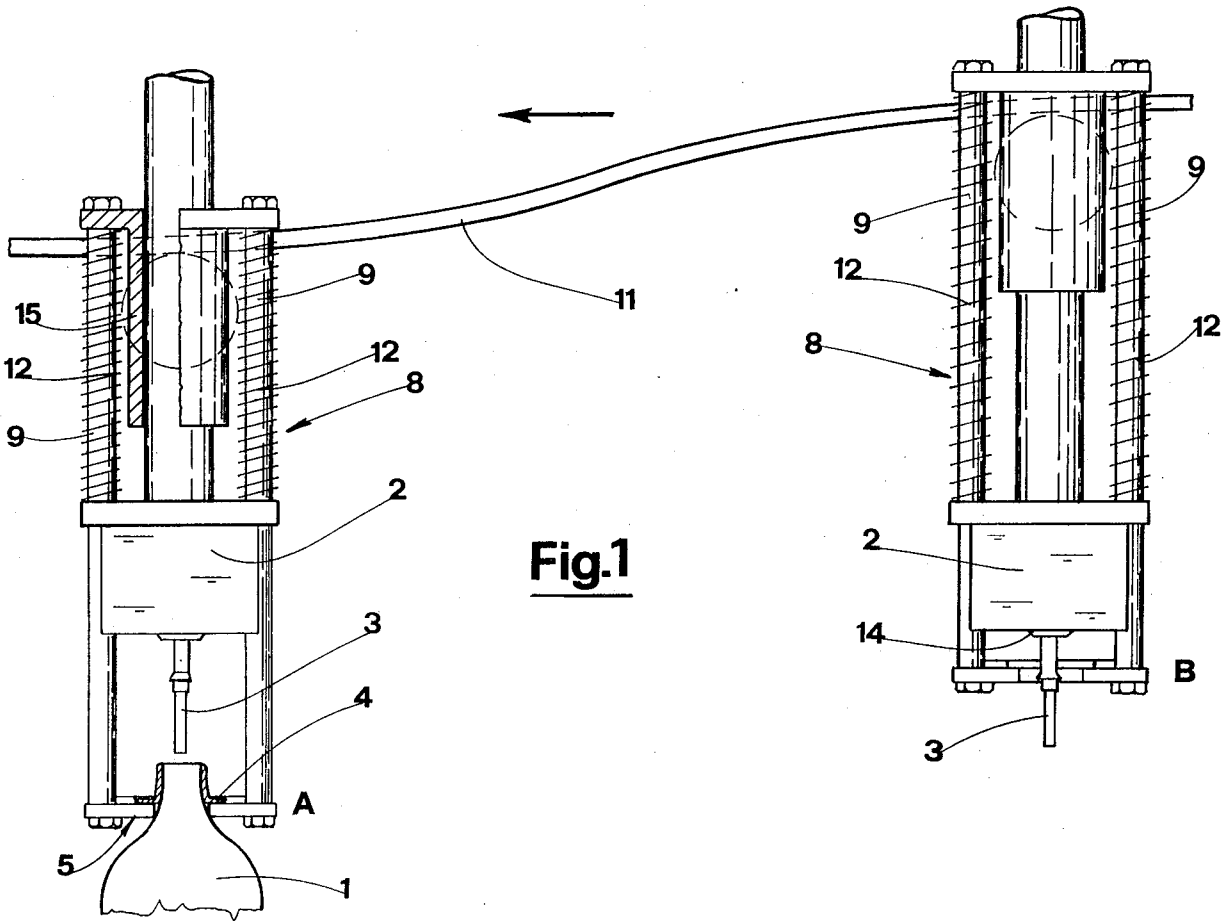
FIG. 1 is a schematic (drawn in a plane which does not illustrate the curvature of the carousel) showing two devices according to the invention, seen in vertical elevation, and occupying different positions relative to a stationary cam-type guide rail which encircles the automatic machine at least in part.
Figure 3:
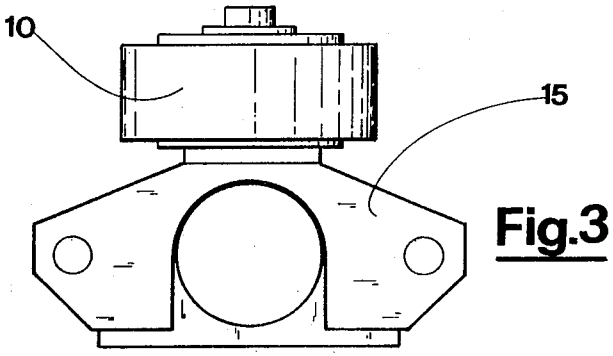
FIG. 3 is a view from above, and in enlarged scale, of a detail of the device described herein.

A device according to the invention is intended for application, in the majority of cases, to automatic bottling machinery of the type utilized for continuous liquid-batching processes. An automatic machine of the type is generally designed as a carousel fitted with a plurality of filler valves, which turn as one with the carousel in continuous rotation, and which in most instances receive liquid for bottling from above by way of respective control cocks.

The valves utilized in such a machine (which are known to those skilled in the art) comprise a body 2, the top section of which incoporates a cock regulating the flow of liquid for bottling, and the bottom section of which incorporates a tube 3 through which the liquid flows out and into the bottle.

During operation of the machine, a bottle 1 is offered to the single valve and filled with liquid as the carousel rotates. Bottles are conveyed into the carousel by an infeed capstan, and conveyed away from the machine by an exit capstan when full. Neither the carousel nor its capstans are illustrated, since such components, like the filler valves, are known to those skilled in the art, and in any case are not central to the subject matter of the disclosure.

A device according to the invention comprises a clamping medium which, in the embodiments illustrated, consists of a plate 5 which exhibits a recess 6 shaped such as to accommodate at least part of the neck of a bottle. The contour of the recess 6 is embodied with a contact surface 7 designed to mate with the external projection 4 with which the neck of a standard production bottle is provided, in most cases. The method by which the plate 5 associates with the body 2 of the valve (to be explained in greater detail in the course of the description) is such as to ensure that a bottle engaged by the recess 6 will be coaxially-disposed with respect to the valve tube 3.

The device further comprises actuator means which operate the clamping medium, or plate 5, allowing it to slide in an axial direction, relative to the body 2 of the valve. The sliding motion produced occurs between a lowered position denoted A (FIG. 1) wherein the plate 5 and the bottle engaged thereby lie beneath the tube 3, and a raised position denoted B wherein the plate 5 is brought up to the level of the tube 3, and the tube is inserted directly into the neck of the bottle.

Actuator means according to the invention consist of a frame 8 embodied as a sleeve 15, able to slide in an axial direction relative to the body 2 of the valve, and integral with two upright members 9 disposed parallel with the axis of the valve, to whose bottom ends the plate 5 is fastened.

Tensioning means are located between the frame 8 and the body 2 of the valve for the purpose of controlling the plate 5, keeping it raised when in position B, and ensuring its stability when lowered in position A. In the embodiment shown in FIG. 1, such tensioning means take the form of coil springs 12 which ensheath the two upright members 9 of the frame, whereas in the embodiment shown in FIG. 2, the same tensioning means take the form of pressurized fluid (compressed air in the great majority of cases) stored in a fluid-tight chamber 13 located between frame and valve. The volume of such a chamber 13 varies in response to the sliding motion of the frame relative to the body of the valve, and will decrease progressively with passage of the plate 5 from raised position B to lowered position A, thereby compressing the fluid and causing it to work in opposition to the downward tendency of the plate 5.

10 denotes a roller which is integral with the frame 8 and engages a cam-type guide rail 11 during the carousel's rotation. The guide rail 11 remains stationary during such rotation, and contact between rail and roller brings about downward slide of the frame with respect to the body of the valve, as will become clear in the course of the description. The body of the valve further comprises an annular seal 14 against which the mouth of the bottle urges when the plate 5 is brought into raised position. The seal 14 serves to avoid any escape of gas from the bottle during filling in those processes where the liquid batched may be gassy, in which case an opening will be provided by way of which to vent air from the bottle.

Operation of the device is as follows.

The tensioning means incorporated into the device tend to urge the plate 5 constantly in the direction of raised position B. With the revolving carousel set in motion, a given valve will be brought into the area of the infeed capstan, and its roller 10 will engage the stationary guide rail 11, whereupon the entire valve will follow the profile of the guide rail as in FIG. 1 (the arrow indicates the direction of the valve's ongoing movement) occasioning downward movement of the plate 5 into lowered position A.

With the plate in this position, the neck of a bottle 1 brought onto the carousel by the infeed capstan can enter the recess 6 offered by the clamping medium, with its external projection 4 locating on the contact surface with which the plate is provided.

The carousel continues to turn, and the roller 10 separates from the guide rail 11. The tensioning means now bring about re-ascent of the plate 5 together with the bottle engaged therein, such that the plate regains position B, and the filler tube 3 is inserted into the bottle neck. The tensioning means now serve to keep the mouth of the bottle urged against the annular seal 14.

The valve and bottle continue to rotate as one with the carousel in the position thus gained, and a set of devices (not illustrated) cause a cock to open, thereby permitting flow of the liquid out through the tube 3 and into the bottle. Thus it comes about that the bottle is clamped and filled during rotation of the carousel.

As the full bottle approaches the exit capstan, the roller 10 engages a further guide rail which, in like manner to the rail 11 located near the infeed capstan, obliges the plate 5 and the full bottle to descend, thereby separating the bottle neck from the tube 3 and permitting removal of the bottle from the carousel altogether by way of the exit capstan.

Figure 2:
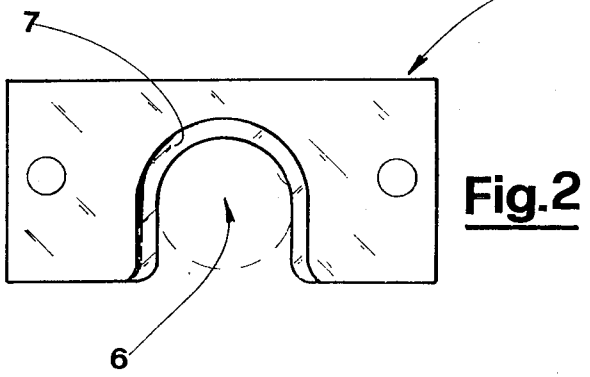
FIG. 2 is a view above, and in enlarged scale, of an embodiment of the clamping medium.
Figure 4:
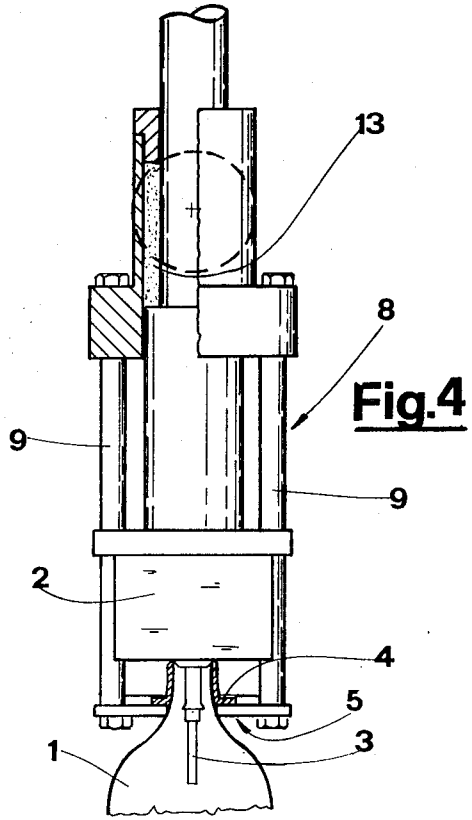
FIG. 4 is the vertical elevation of a further embodiment of the device described herein.

It is assumed in the foregoing description and in FIG. 1, for the purposes of illustration, that separate guide rails 11 will be installed for infeed and exit. In the event that infeed and exit capstans are located close together however, as is not infrequently the case with present-day machines, one rail only may equally well be utilized, thereby maintaining the plate 5 in lowered position A throughout its progress from exit capstan back to infeed capstan.

The device thus described permits utilization of bottles having limited strength such as those fashioned from plastic, since all of the mechanical effort produced in raising the bottle and urging it against the seal 14 is discharged upon the generally tough external projection 4 with which the necks of such bottles are provided. In other words, no stress is imparted to the remainder of the bottle, which therefore will remain undistorted. It will be clear enough that the device may be utilized to considerable advantage for filling glass bottles also, particularly where fashioned from a thin type of glass.

Operation of the device is particularly dependable, since adoption of the cam-and-follower principle (roller 10 and guide rail 11) ensures that no contact can be made between bottle neck and filler tube at the two points where bottles are fed into and conveyed away from the carousel.

What is claimed:

1. An automatic bottling machine bottle holder for filling a bottle having a circumferential neck projection on its neck adjacent to its open end comprising; a bottle support means at one end thereof, said bottle support means having an opening therein sized to receive the bottle neck and sized smaller than the circumferential neck projection, to thereby support the bottle when the neck projections rests thereon; a valve means positioned between said one end and the other end of said holder, said holder being movable with respect to said valve means, said valve means having a filler tube projecting from one end thereof toward said opening, and said filler tube and said opening being positioned to permit the filler tube to project through said opening when said opening is moved a predetermined distance towards said valve means.

2. The holder of claim 1 comprising: a frame having two upright members disposed parallel with the axis of the valve means and slidably connected in an axial direction relative to the valve; tensioning means located between the frame and the valve to urge the bottle support means in a raised position said bottle support means being attached to the bottom of said frame, a roller connected to top portion of the frame and designed to engage a stationary cam-type guide rail during rotation of the bottling machine, thereby causing the clamping medium to be distanced from the body of the valve.

3. The holder of claim 2 wherein said tensioning means consist of coil springs ensheathing the upright members of the frame.

4. The holder of claim 2 wherein said tensioning means consist of fluid contained in a fluid-tight chamber located between the frame and the valve.

5. The holder of claim 1 wherein said bottle support is a plate which has a counterbored opening to provide a contact surface on which the bottle projection is adapted to sit.

6. The holder of claim 1 wherein the valve incorporates an annular seal encircling the filler tube, against which the mouth of the bottle is urged when being filled.

* * * * *